US007607552B2

(12) United States Patent
Efstathiou

(10) Patent No.: US 7,607,552 B2
(45) Date of Patent: Oct. 27, 2009

(54) WASTE CONTAINER WITH FOOT OPERATED LID CONTROL DEVICE

(75) Inventor: Polychronis Efstathiou, Volos (GR)

(73) Assignee: Hellenic Environmental Systems Industry SA, Aigio Achaias (GR)

( * ) Notice: Subject to any disclaimer, the term of this patent is extended or adjusted under 35 U.S.C. 154(b) by 540 days.

(21) Appl. No.: 11/547,695

(22) PCT Filed: Apr. 8, 2004

(86) PCT No.: PCT/GR2004/000022

§ 371 (c)(1),
(2), (4) Date: Oct. 5, 2006

(87) PCT Pub. No.: WO2005/097630

PCT Pub. Date: Apr. 8, 2004

(65) Prior Publication Data

US 2008/0272119 A1 Nov. 6, 2008

(51) Int. Cl.
*B65D 43/26* (2006.01)

(52) U.S. Cl. ..... 220/264; 220/262; 220/263

(58) Field of Classification Search ..... 220/262, 220/263, 264, 908
See application file for complete search history.

(56) References Cited

U.S. PATENT DOCUMENTS

| | | | |
|---|---|---|---|
| 4,853,985 | A | 8/1989 | Perry |
| 4,892,218 | A | 1/1990 | Reiling |
| 5,819,332 | A | 10/1998 | Perry |
| 6,032,305 | A | 3/2000 | Tedrick |

*Primary Examiner*—Anthony D Stashick
*Assistant Examiner*—Madison L Wright

(57) ABSTRACT

A waste container (1) with a foot operated lid control device comprising a frontal rod (10) and a rear rod (11) of pivotally connecting the lid to the waste container, the lid (2) performing a swinging movement of 90° during both the opening and closing thereof, the lid control device preferably exercising an overall control during both opening and closing of the lid when being activated via discreet acts of exertion of pressure upon a pedal (5) of a foot operated lever (3). A safety enhancing feature of a compression spring (18) mounted onto the rear rod (11) is provided for a decelerated return of lid (2) during a predetermined final angular displacement thereof in the direction of closure. The waste container further includes means of securing the lid (2) at the fully opened condition to facilitate mechanical waste collection operations.

7 Claims, 5 Drawing Sheets

WASTE CONTAINER WITH FOOT OPERATED LID CONTROL DEVICE

The invention relates to a waste container equipped with a foot operated lid control device activated both in the direction of opening and of closing the lid assembly.

Foot operated lid opening devices of waste containers of the prior art comprise a lever assembly actuated by pressing upon a foot operated pedal at the bottom of the frontal side of the waste container and exerting an impulse onto the lid that is pivotally mounted at the top of the rear side of the container, the lid thereby rotating around such pivotal connection in the direction of opening. Depending on the magnitude of such exerted impulse, it is possible that the angle of rotation of the lid exceeds 90° and this results to the lid falling rearwards under gravity with a speed being enhanced by the momentum already acquired, thereby eventually striking upon the exterior of the rear side of the container, wherein rotation thereof by an angle of 270° is required to return it to the closed position. Foot operated lid opening mechanisms of the prior art do not provide for such a return operation of the lid and this results to either the lid being left open with obvious adverse hygienic effects or to having to manually return the lid to closed position. It is further noted that such undesirable violent rotation of the lid due to excessive impulse applied on the foot pedal is by any means a risk factor of causing accidents, such risk factor becoming multifold when children come to make use or to "play with" the waste container.

With the scope of averting such undesirable angle of rotation of the lid, lid opening mechanisms are employed to provide for the lid being restricted in its opening course to an angle that in practice tends to be by far less than 90°, thereby leading to a rather impractical condition, especially when there is a need for disposal of rather bulky items into the container.

At further drawback of waste containers with foot operated lid opening mechanisms of the prior art is that pressing and subsequently releasing the foot pedal results, if the above-mentioned undesirable excessive rotation over 90° is avoided, to directly manifested opening of the lid and abrupt return of the same under gravity to the closed position. Herein lies manifestation of a further risk factor associated on the one hand with the mobility restrictions imposed on users who have to stand on one foot whilst depositing litter into the container since their other foot must exert a permanent pressure onto the foot pedal and on the other hand with the involuntary abrupt return of the lid to closed position a soon as the foot pedal is released if such release does not take place gradually, wherein an injury might occur if a hand or a head is located somewhere in the course of the speedily returning lid, such injury possibly becoming severe with heavy metal lids.

Amongst prior art documents GB 2205730, U.S. Pat. No. 4,892,218, U.S. Pat. No. 4,150,764 and CH 675236 describe waste containers incorporating a foot pedal operated lid opening mechanism, wherein is encountered the aforementioned disadvantage of the user having to exert a permanent pressure on the foot pedal in order to maintain the lid at an open condition and of the lid being solely controlled during opening and let fall under gravity during the reverse closing operation with the user being unable to mechanically control such closing operation, since the only means available to the user for effecting a relatively controlled closing operation is the gradual release of the foot pedal. All aforementioned lids are hinged to the waste container along a single plane of pivotal connection. Furthermore, in U.S. Pat. No. 4,892,218 the lid is apt to falling rearwards if an excessive lifting force is applied at the foot pedal, especially if such force is applied instantaneously, whilst in U.S. Pat. No. 4,150,764 the opening angle is restricted to a magnitude substantially less than 90°, thereby inhibiting disposal of larger items into the container. On the other hand, the lid in CH 675236 is openable to an angle exceeding 90°, but it incorporates a stop lever to prevent it from falling rearwards, however allowing sufficient opening for the disposal of larger items. Nevertheless, as the opening angle exceeds 90°, the lid can only return to the closed position manually.

Still another drawback in any of the above documents of the prior art is the lack of any mechanical provision for decelerating the lid during its falling under gravity to the closed condition and avert hereinabove mentioned possible accidents. The only means of effecting a controlled return of the lid to the closed position is the user sensitive act of gradually releasing of the foot pedal.

The object of the present invention is to provide a waste container with a foot operated lid control device, wherein a 90° swinging movement of the lid is carried out during both the opening and closing operation thereof, such 90° swinging movement of the lid corresponding to an arc of rotation of 270° of the lids of the prior art, wherein the lid control device preferably provides for an overall control of the lid assembly being driven from the closed to opened position and vice versa, wherein such overall control is implemented via discreet, instantaneous and non permanent exertion of pressure upon the foot pedal.

A further object of the invention is to enhance safety measures for the waste container, especially in view of safety requirements for children, by the inclusion of means in said foot operated lid control device providing a decelerated return of the lid during a predetermined final arc of swinging thereof prior to arriving at the closed position, thereby averting possible accidents that might be caused if a hand or a head is interposed in the course of closing of the lid.

Still a further object of the invention is to provide means of temporarily locking the lid at the opened condition, so as to allow for mechanical waste collection.

The invention will be hereinafter described in detail by reference to the accompanying drawings wherein are depicted illustrative and non confining embodiments thereof.

Figure 1:
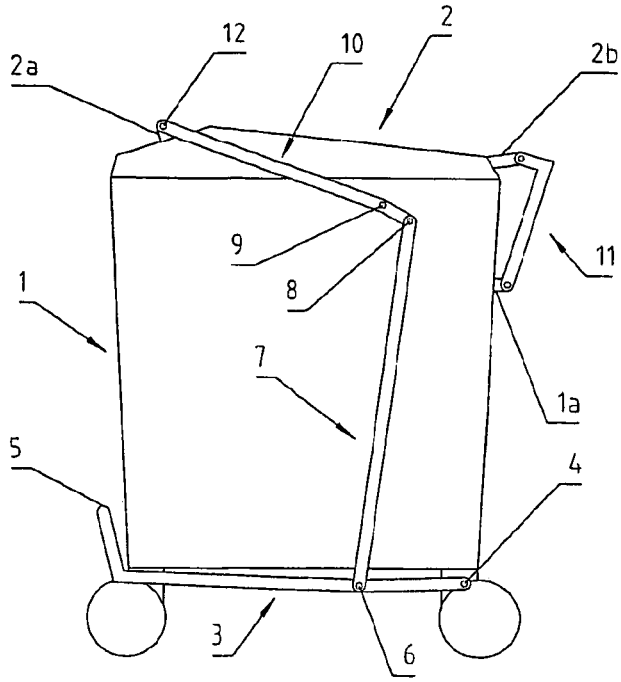
FIGS. 1-3 show side views of a first embodiment of the waste container with the foot operated lid control device of the invention, the lid being respectively shown in the closed position, in an intermediate position and in the fully opened condition.

The waste container 1 depicted in the drawings is a generally parallelepipedal construction with four wheels and a lid 2 correspondingly shaped to fit onto the upper rim of the waste container for a tight closure thereof whilst in the closed condition. A foot operated lever 3 is provided at the bottom of the container with a pivotal connection 4 at the rear of each one of the sides of the waste container and an upwardly projecting foot pedal 5 extending linearly along the frontal side thereof.

Figure 4:
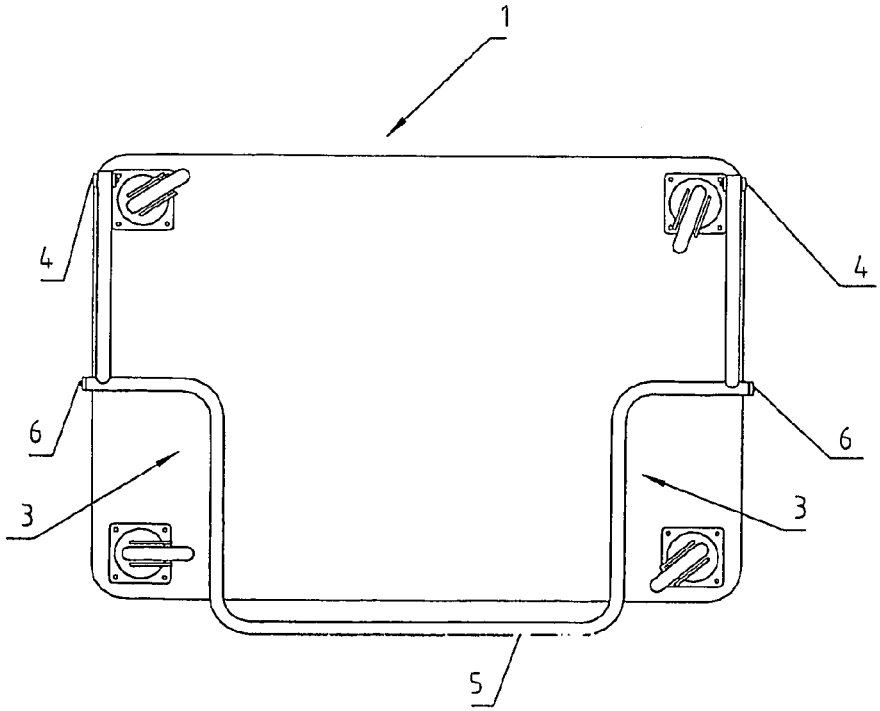
FIG. 4 shows a planar view at the bottom of the waste container illustrating the configuration of the foot operated lever and of the foot pedal thereof.

Whilst the lid control device of the invention will be hereinafter described by reference to the rod assembly at one side of the waste container only, it is herein made clear that, as depicted in the bottom planar view of FIG. 4, the lid control device of the invention comprises an arrangement of identical rod assemblies moving in precise synchronization at each one of the lateral sides of the waste container.

Figure 2:
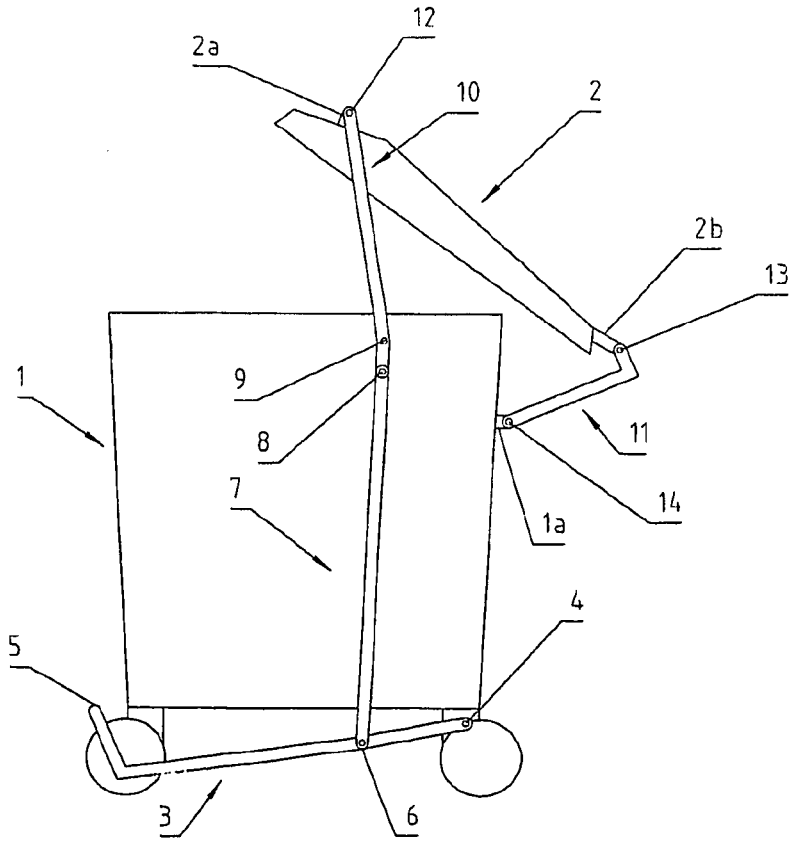
Figure 3:
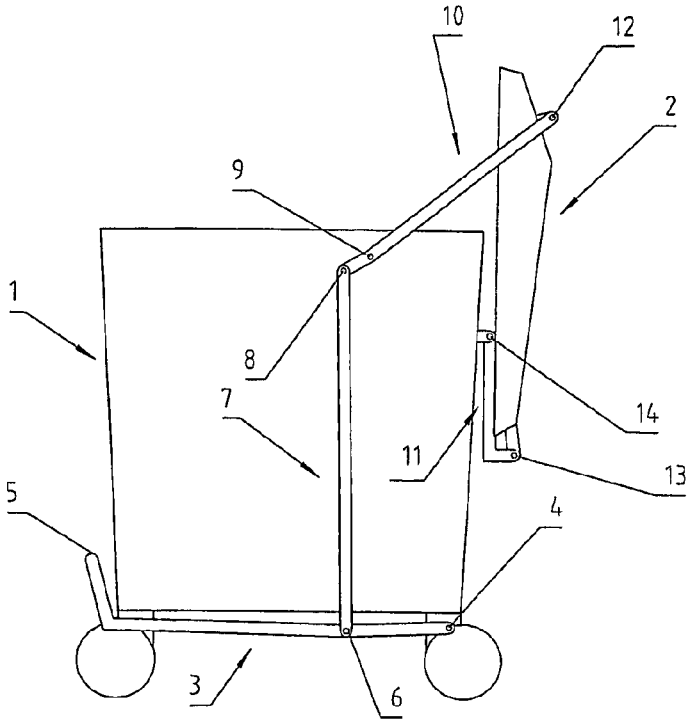

Henceforth, by reference to FIGS. 1-3 and to one side of the waste container only, an upward extending connecting rod 7 has an end pivotally mounted at an intermediate location 6 along the above foot operated lever 3 and another end pivotally mounted at a junction 8 onto a free end of a first frontal rod 10 of the lid control device of the invention. The above first frontal rod 10 is further rotatably mounted onto the body of the waste container 1 at a fixed junction 9 in proximity to the abovementioned junction 8 with the upward extending connecting rod 7. Further the other free end of the first frontal rod 10 is pivotally connected at a junction 12 to a frontal protrusion 2*a* of the lid 2.

A second rear rod 11 of the lid control device of the invention is provided, that is an L section rod with an end thereof being pivotally connected at junction 13 to a rear protrusion 2*b* of the lid 2 and the other end thereof being pivotally connected at junction 14 to a rear protrusion 1*a* of the waste container 1.

The lid control device of the invention incorporating the above pair of rods, i.e. the frontal rod 10 and the rear rod 11, operates as follows:

From the closed position shown in FIG. 1, wherein pivotal connection 8 of the frontal rod 10 to the connecting rod 7, as viewed in this lateral side of the container, lies to the right of the fixed junction 9 of the frontal rod 10 to the body of the waste container, the lid 2 begins a swinging rearward movement in the direction of opening when foot pedal 5 of the foot operated lever 3 is pressed downwards and subsequently connecting rod 7 is pulled downwards.

Due to the pivotal connection 9 of the frontal rod 10 to the body of the waste container 1 acting as a fulcrum in the rotation thereof the downward movement of connecting rod 7 exerts a pulling action on the frontal rod 10 and causes a clockwise rotation thereof around the fixed junction 9 for as long as the foot pedal 5 is being pressed and until the latter arrives at an intermediate position depicted in FIG. 2 that indicates the end of stroke position of the foot pedal 5 and accordingly the bottom dead center of the foot operated lever 3. It is noted that at this particular instant, junctions of pivotal connection 6, 8 and 9 all lie along the same line. In the same time, during such first arc of movement of the lid 2 in the direction of opening, the rear portion of the lid 2 takes a rearwardly extending position, such position being determined by the dimensions and angle of rotation of the rear rod 11 and its pivotal connections 13, 14 with the lid 2 and the waste container body respectively.

When the lid 2 comes to the position depicted in FIG. 2, it may no longer move under the action of the foot operated lever 3. However due to the acquired momentum and to the pivotal connection of the rear end of the lid 2 to the rear rod 11 of the lid control device of the invention, the swinging movement thereof continues in the same direction until it eventually reaches the fully opened condition shown in FIG. 3, wherein pivotal connection 8 of the frontal rod 10 to the rod 7, as viewed in this lateral side of the container, lies to the left of the fixed junction 9 of the frontal rod 10 to the body of the waste container, the lid having thereby completed the swinging movement resulting in a displacement thereof by 90°. During, the final arc of displacement of the lid 2, past the position of unstable equilibrium depicted in FIG. 2, the foot operated lever 3 returns to the top dead center thereof and the foot pedal 5 can be pressed again to effect return of the lid 2 to the closed position. As foot pedal 5 is pressed downwards, connecting rod 7, due to the fulcrum function of fixed junction 9, exerts a pulling action on the frontal rod 10, thereby causing it to rotate in an anticlockwise direction around fixed junction 9 for as long as the foot pedal 5 is being pressed and to continue such rotation, past the position of unstable equilibrium of FIG. 2, due to the momentum already acquired until the lid 2 comes to the final closed position being depicted in FIG. 1.

From the above description it clearly follows that the lid control device of the invention comprising the two rods 10, 11 pivotally connected to the lid, so as to determine the swinging movement thereof along two discrete planes of pivotal connection, i.e. a first plane of pivotal connection incorporating the line passing through fixed junctions 9 on either side of the waste container and a second plane of pivotal connection incorporating the line passing through fixed junctions 13 at the rear of the waste container, solves the aforementioned problems of the prior art by offering adequate control of the lid 2 throughout the movement thereof from the closed to the opened condition and vice versa.

It is hereby noted that the selection of the specific locations of pivotal connections 9, 12 of the frontal rod 10 and 13, 14 of the rear rod 11 is such as to obtain non obstructed movement of the lid during the 90° swinging movement thereof from the open to closed position and vice versa and ensure emptying of the waste container during a mechanical waste collection without it being undesirably entangled with the means employed by the waste collection vehicle. Further, attention is drawn to selection of locations for the above pivotal connections, such as to obtain substantially similar requirements of force to be exerted onto the foot pedal, both in the direction of opening and closing of the waste container.

On the other hand, selection of the specific locations of pivotal connections 4, 6 of the foot operated lever 3 and pivotal connection 8 of the connecting rod 7 to the frontal rod 10 is such as to obtain a practically equivalent stroke of the foot operated lever 3 and of the foot pedal 5 in the corresponding subsequent swinging of the lid from the condition of FIG. 1 to the condition of FIG. 2 and from the condition of FIG. 2 to the condition of FIG. 3 and vice versa and in the same time to ensure that the foot operated lever 3 and pedal 5 require a certain appropriately predetermined force to operate and that the force being transferred though the connecting rod 7 is as low as possible so as to refrain from exerting excessive forces at the pivotal connection 4 of the foot operated lever 3 to the body of the waste container and at the fixed junction 9 wherein frontal rod 10 is connected to the body of the waste container of the invention.

In order to obtain the above described preferred operational characteristics of the lid control assembly of the invention with practically equivalent strokes of the foot operated lever 3 and of the foot pedal 5 in the subsequent arcs of displacement in the swinging movement of the lid 2 from the condition of FIG. 1 to the condition of FIG. 2 and from the condition of FIG. 2 to the condition of FIG. 3 and vice versa and also to provide for practically equivalent energy related to each one of the abovementioned practically equivalent strokes and further to provide for the feature of deceleration of the lid during the terminal angular displacement thereof during closure, such terminal angular displacement corresponding to approximately two tenths of the overall angular displacement of the lid, so as to avert accidents due to possible interposition of a head or a hand in the course thereof, a careful analysis of moments being applied throughout the swinging movement of the lid has to be made and especially attention has to be paid to the moment being built during the initial angular displacement of the lid during opening to be as low as possible in order to obtain the advantageous lid deceleration characteristic during the equivalent terminal angular displacement of the lid before closure.

Figure 5:
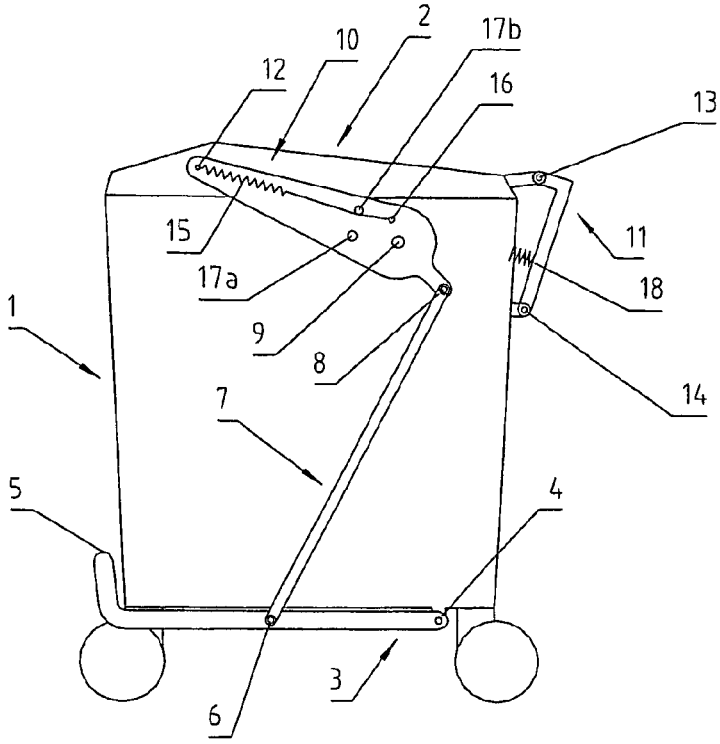
FIGS. 5-7 show side views of an advantageous preferred embodiment of the waste container of the invention with the lid respectively shown in the closed position, in an intermediate position and in the fully opened condition.

The alternative preferred embodiment of the invention depicted in FIGS. 5-7 successfully employs an arrangement of elastically loaded spring means 15 in order to attain the hereinabove mentioned advantageous characteristics of proper angular momentum being exerted during the swinging movement of the lid in an opening or closing operation thereof, especially as it moves past the condition of unstable dynamic equilibrium depicted in FIG. 6. Thus, in this embodiment the frontal rod 10 of the lid control device of the invention is of a planar configuration and, in the interior thereof, a resilient spring 15, subject to tensile, bending and torsional loading during the swinging movement of the lid, extends between the point of pivotal connection 12 of the frontal rod 10 to the lid 2 and a point 16 of fixed connection onto the body of the waste container 1. A preferred location of point 16 is that which ensures that when the lid reaches the point of unstable dynamic equilibrium depicted in FIG. 6, spring 15 is linearly oriented and no torsional and/or bending stress is exerted thereupon. Torsional and/or bending stresses are exerted onto a flexible end portion of spring 15, at the proximity of pivotal connection 9 of the frontal rod 10 to the body of the waste container 1, wherein this flexible end portion of spring 15 lies in between a pair of shaft protrusions 17*a* and 17*b* located onto the frontal rod 10 and alternatively interacts with either shaft protrusion 17*a* when the lid 2 is fully opened (FIG. 7) or with shaft protrusion 17*b* when the lid 2 is closed (FIG. 5). Such interaction of spring 15 with shaft protrusions 17*a* or 17*b* is manifested as tensile stress is exerted onto spring 15 due to a pressure exerted onto the abovementioned flexible end portion thereof by either shaft protrusion 17*b* when lid 2 is closed or by shaft protrusion 17*a* when lid 2 is opened, thereby enhancing the building up of moment around fixed junction 9 to facilitate starting of a lid opening or lid closing operation respectively. This arrangement of spring 15 therefore satisfies the above described preferred operational characteristics of the lid control assembly of the invention, i.e. the achievement of practically equivalent strokes of the foot operated lever 3 and of the foot pedal 5 in the subsequent displacement of the lid 2 from the condition of FIG. 5 to the condition of FIG. 6 and from the condition of FIG. 6 to the condition of FIG. 7 and vice versa and accordingly the achievement of counter acting moments being built as the lid approaches the fully opened or closed position thereby facilitating the return thereof in the direction of closure or opening respectively, whilst the latter moment applied during closure of the lid also has a beneficial effect in obtaining the hereinabove mentioned desired deceleration characteristic.

In accordance to a preferred embodiment of the invention the advantageous feature of deceleration of the lid during a final angular displacement thereof of the order of two tenths of the overall stroke thereof as it approaches the position of closure so as to avert accidents due to possible interposition of a head or a hand in the course thereof is further enhanced by means of a compression spring 18, one end of which is mounted onto the rear rod 11 of the lid control assembly and its other end is free to come in contact with the rear surface of the container as the lid approaches the above mentioned final angular displacement before closure, thereby decelerating and averting possible accidents.

Figure 6:
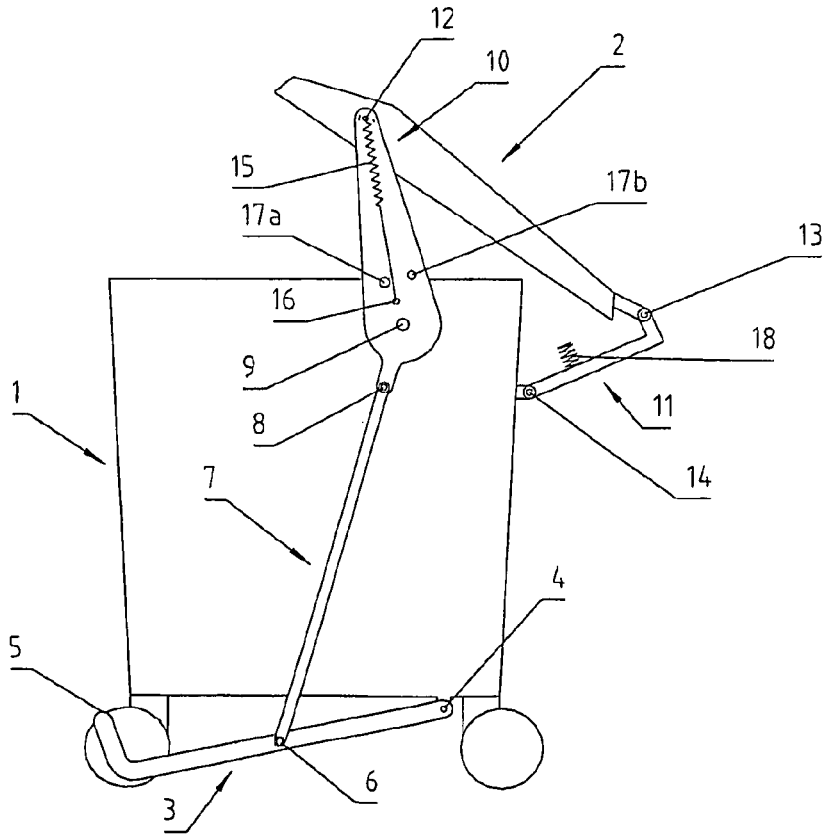
Figure 7:
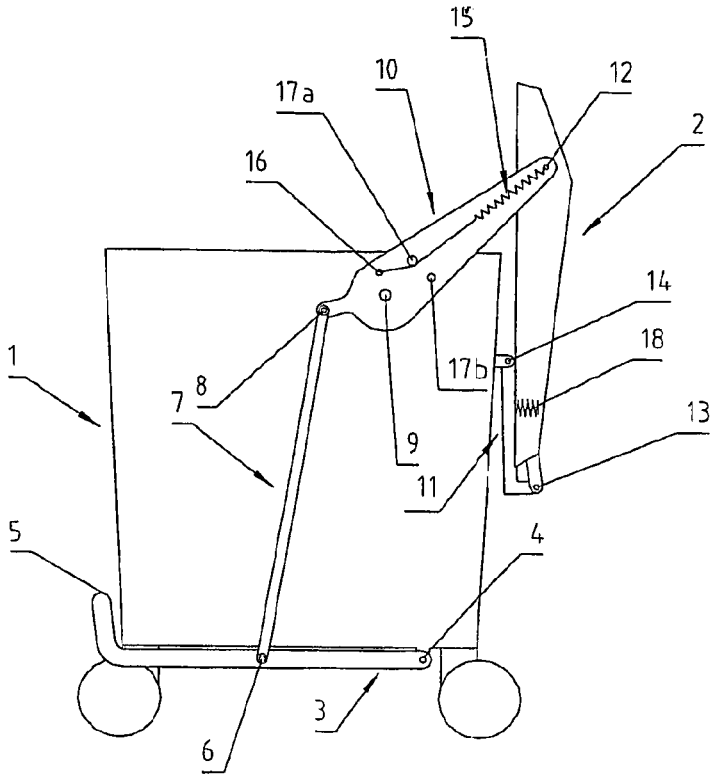
Figure 8:
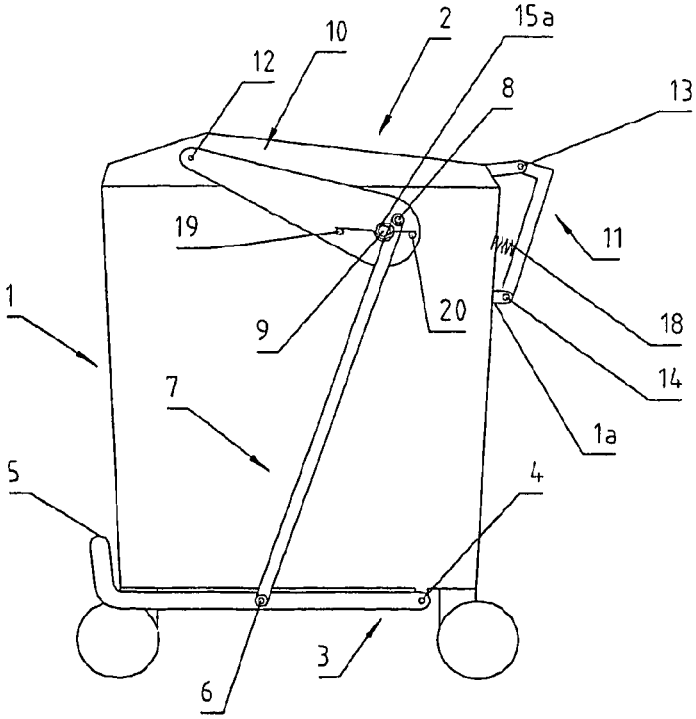
FIGS. 8-9 show a further less advantageous alternative embodiment of the waste container of the invention with the lid being respectively shown in the closed position and in the fully opened condition.
Figure 9:
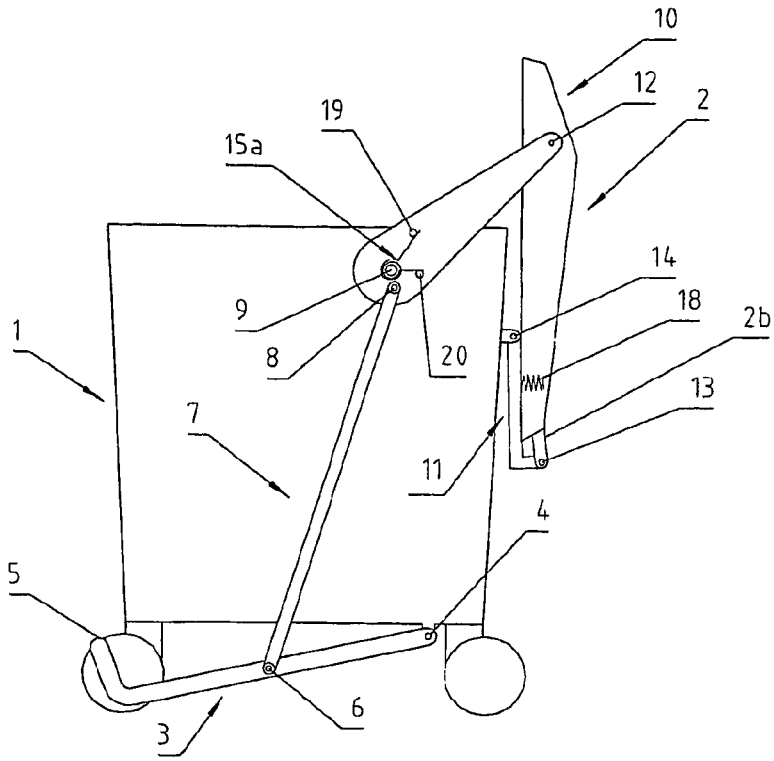

FIGS. 8-9 depict an alternative embodiment of the invention, wherein pivotal connection 8 of the connecting rod 7 to the frontal rod 10 always lies to the right of fixed junction 9, as viewed in this lateral side of the container, during either opening or closing operation of the lid that thereby does not pass through the intermediate position of unstable dynamic equilibrium depicted in FIG. 2 or FIG. 6. Instead a single act of exerting pressure upon the pedal 5 of the foot operated lever 3 results in the performance of a clockwise 90° swinging movement of the lid from the closed position of FIG. 8 to the fully opened position of FIG. 9, whilst release of the pedal 5 of the foot operated lever 3 results in the performance of an equivalent anticlockwise 90° swinging movement of the lid from the fully opened position of FIG. 9 to the closed position of FIG. 8. In this case a spiral return spring 15*a* is provided between fixed positions 19 on the body of the waste container 1 and 20 onto the frontal rod 10 of the lid control assembly, wherein the spiral return spring 15*a* is loaded during the lid opening operation and unloaded during the subsequent closing operation thereof.

In the above embodiment of FIGS. 8-9, a similar compression spring 18, one end of which is mounted onto the rear rod 11 of the lid control assembly and its other end is free to come in contact with the rear surface of the container 1 as the lid comes to a final angular displacement before closure, can be employed in order to provide for the advantageous feature of lid deceleration during a final angular displacement towards closure thereof and thereby for averting possible accidents, whilst in the same time providing for the building of an advantageously counter acting moment thereby facilitating the initial starting towards opening.

The waste container of the invention is appropriately adapted to facilitate gripping and emptying the contents thereof during a mechanical waste collection process. In this respect it is particularly important to ensure that the lid 2 remains open despite of the overturning of the waste container 1 by the waste collection vehicle in order to empty the contents thereof.

Figure 10:
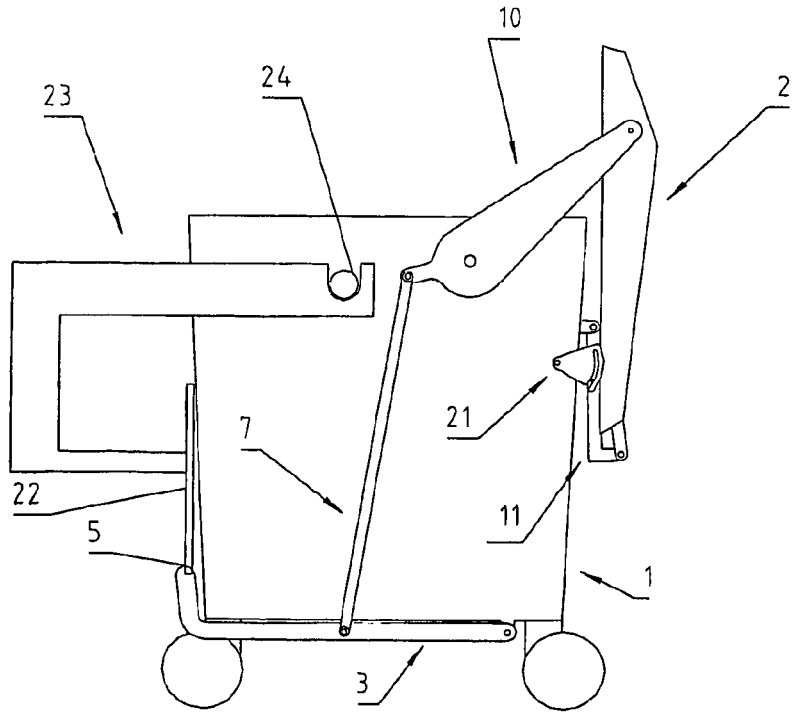
FIG. 10 shows an illustrative embodiment of means for securing the lid of the waste container of the invention at the fully opened condition and of gripping the container during the mechanical waste collection process.

In accordance to a preferred embodiment of the invention as shown in FIG. 10, the waste collection vehicle grips the waste container by means of gripping arms 23 engaging into protruding shafts 24 at the sides thereof. In order to stabilize the lid 2 in the opened position, one might either employ a manually operated hooking means 21 at the rear of the container that connects the lid to the body of the waste container or alternatively use a manually operated lever 22 provided as an extension of the foot pedal 5 that blocks the foot operated lever as the waste container is overturned for emptying the contents thereof and thereby maintains the lid thereof in the opened condition. The above mentioned lever 22 may in an alternative embodiment of the invention be adapted to work as a hand operated lever for effecting the lid opening and closing operations.

The invention claimed is:

1. Waste container for mechanical waste collection comprising a generally rectangular body (1) with a closed bottom end and an open upper end, a lid (2) correspondingly shaped to fit onto therein of said open upper end of the waste container for a tight closure thereof whilst in a closed condition, a foot operated lever (3) being provided at the bottom of the container with pivotal connections (4) at the rear of either one of the lateral sides of the waste container and an upwardly linearly projecting pedal (5) at the frontal side thereof, said foot operated lever (3) being pivotally connected at an intermediate location (6) thereof to upwardly extending connecting rods (7) at each one of the lateral sides of the waste container, said upwardly extending connecting rods (7) thereby transmitting movement of said foot operated lever (3) to a lid control device, characterised by that said lid control device enabling a 90° swinging movement of said lid (2) during opening or closing operation thereof, said lid control device having located in each one of the lateral sides of the waste container a first frontal rod (10) extending from a frontal point of pivotal connection (12) at a frontal protrusion (2*a*) of said lid (2) to a rear point of pivotal connection (8) to said upwardly extending connecting rod (7), said first frontal rod (10) being further rotatably mounted onto the body of the waste container (1) at a fixed junction (9) in proximity to said rear point of pivotal connection (8) to said upwardly extending connecting rod (7) and a second rear rod (11), said rear rod (11) having an L section configuration extending from an upper point of pivotal connection (13) at a rear protrusion (2*b*) of said lid (2) to a lower point of pivotal connection (14) to a rear protrusion (1*a*) of said waste container (1), said fixed junction (9) of the frontal rod (10) to the body of the waste container (1) acting as a fulcrum for the rotation of said frontal rod (10), wherein a downward movement of connecting rod (7) in response to a single instantaneous pressing of said pedal (5) of the foot operated lever (3) exerts a pulling action on said frontal rod (10) and causes a clockwise rotation thereof and a swinging movement of said lid (2) simultaneously around said fixed junction (9) of said frontal rod (10) to the body of the waste container (1) and around said upper point of pivotal connection (13) and said lower point of pivotal connection (14) of said rear rod (11), a compression spring (18) being provided for a decelerated return of said lid (2) during a predetermined final arc of the anticlockwise rotation thereof prior to arriving at the closed position, one end of said compression spring (18) being mounted onto said rear rod (11) of the lid control device and another end of said compression spring (18) being free to come in contact with the rear surface of the body of the waste container (1) during said predetermined final arc of the anticlockwise rotation of the lid prior to arriving at the closed position, said final arc of angular displacement of the lid being equivalent to approximately two tenths of the overall angular displacement thereof, said compression spring (18) thereby decelerating and averting possible accidents due to interposing of a hand or head in the course of closing of the lid, said waste container further including means of securing said lid (2) at the fully opened condition to facilitate mechanical waste collection operations.

2. Waste container according to claim 1, wherein said means of securing said lid (2) at the fully opened condition to facilitate mechanical waste collection operations is a manually operated hooking means (21) at the rear of the waste container that connects said lid (2) to the body of the waste container (1).

3. Waste container according to claim 1, wherein said means of securing said lid (2) at the fully opened condition to facilitate mechanical waste collection operations is a manually operated lever (22) provided as an extension of said foot pedal (5) that blocks said foot operated lever (3) as the waste container is overturned for emptying the contents thereof and thereby maintains the lid thereof in the opened condition, wherein said manually operated lever (22) may further be adapted to work as a hand operated lever for effecting the lid opening and closing operations.

4. Waste container according to claim 1, further comprising a spiral return spring (15*a*) fixedly mounted between positions (19), 20 on the body of the waste container (1) and on the frontal rod (10) of the lid control device, wherein exertion of pressure upon said pedal (5) of the foot operated lever (3) results in the performance of a rearwardly clockwise swinging movement of 90° of said lid (2) from the closed to the fully opened position, whilst release of said pedal (5) of the foot operated lever (3) results in the performance of a forwardly anticlockwise swinging movement of 90° of said lid (2) from the fully opened to the closed position under the action of said spiral return spring (15*a*).

5. Waste container according to claim 1, wherein an end of stroke position during pressing downwards of said foot pedal (5) corresponding to the bottom dead center of said foot operated lever (3) is an intermediate position of unstable dynamic equilibrium of said lid (2) during a clockwise rotation thereof in the direction of opening and equivalently during an anticlockwise rotation thereof in the direction of closing, said intermediate position of unstable dynamic equilibrium being the position at which said points (6, 8) of pivotal connection of said upwardly extending connecting rod (7) lie along the same line with said fixed junction (9) of pivotal connection of said frontal rod (10) to the body of said waste container (1), wherein a rearwardly clockwise swinging movement of said lid (2) in the direction of opening is initiated upon pressing downwards of said pedal (5) of said foot operated lever (3), the stroke of said foot operated lever (3) being terminated as the lid (2) arrives at said intermediate position of unstable dynamic equilibrium wherefrom said lid (2), due to the acquired momentum and to the pivotal connection of the rear end thereof to said rear rod (11), continues the swinging movement thereof in the same direction until it eventually reaches the fully opened condition having completed a swinging movement of 90°, whilst said foot operated lever (3) returns to the top dead center thereof and wherein a reverse forwardly anticlockwise swinging movement of said lid (2) in the direction of closing is initiated upon pressing downwards of said pedal (5) of said foot operated lever (3), the stroke of said foot operated lever (3) being again terminated as the lid (2) arrives at said intermediate position of unstable dynamic equilibrium wherefrom said lid (2), due to the acquired momentum and to the pivotal connection of the rear end thereof to said rear rod (11), continues the swinging movement thereof in the same direction until it eventually reaches the fully closed condition having completed a swinging movement of 90° whilst said foot operated lever (3) returns to the top dead center thereof and may be used again in the direction of opening said lid (2).

6. Waste container according to claim 5, wherein the selection of specific locations for said pivotal connections (9, 12) of said frontal rod (10) and (13, 14) of said rear rod (11), as well as the selection of specific locations for said pivotal connections (4, 6) of said foot operated lever (3) and pivotal connection (8) of said connecting rod (7) to the frontal rod (10) is such as to obtain non obstructed movement of the lid during the 90° swinging movement thereof from the open to closed position and vice versa and further obtain preferred operational characteristics of substantially similar energy requirements both in the direction of opening and closing of the waste container and a practically equivalent stroke of said foot operated lever (3) and foot pedal (5) in the corresponding subsequent arcs of displacement of the lid from the opened condition to the intermediate position of unstable dynamic equilibrium and henceforth from the intermediate position of unstable dynamic equilibrium to the fully opened condition and vice versa.

7. Waste container as claimed in above claim 6, further comprising an arrangement of elastically loaded resilient spring means (15) being fixedly mounted and extending between said pivotal connection (12) of said frontal rod (10)

to lid (2) and a point (16) onto the body of said waste container (1), a flexible end portion of said resilient spring means (15) being provided at the proximity of said fixed junction (9) of pivotal connection of said frontal rod (10) to the body of said waste container (1), said flexible end portion of the resilient spring means (15) lying in between a pair of shaft protrusions (17*a*) and (17*b*) located onto the frontal rod (10) and alternatively interacting with either shaft protrusion (17*a*) when the lid (2) is fully opened or with shaft protrusion (17*b*) when the lid (2) is closed, wherein interacting of said flexible end portion of said spring means (15) with shaft protrusions (17*a*) or (17*b*) is manifested as tension being imposed onto said spring means (15) due to a pressure exerted onto said flexible end portion thereof by either shaft protrusion (17*b*) when lid (2) is closed or by shaft protrusion (17*a*) when lid (2) is opened, torsional and/or bending stresses being exerted upon said resilient spring means (15) whilst said lid (2) moves past the point of unstable dynamic equilibrium either in the clockwise direction of opening or in the anticlockwise direction of closing, thereby leading to counter acting moments being built as the lid approaches the fully opened or closed position thereby facilitating the return thereof in the direction of closure or opening respectively, said counter acting moment applied during closure of the lid further having the beneficial effect of decelerating the lid and averting possible accidents due to interposing of a hand or head in the course of closing thereof, said lid control device presenting substantially identical energy requirements both in the direction of opening and closing of the waste container and practically equivalents strokes of said foot operated lever (3) and foot pedal (5) in the corresponding subsequent displacement of the lid (2) from the opened condition to the intermediate position of unstable dynamic equilibrium and henceforth from the intermediate position of unstable dynamic equilibrium to the fully opened condition and vice versa.

* * * * *